US010144604B2

(12) United States Patent
Arikata et al.

(10) Patent No.: US 10,144,604 B2
(45) Date of Patent: Dec. 4, 2018

(54) BANKNOTE STORING/FEEDING UNIT

(71) Applicant: GLORY LTD., Himeji-shi, Hyogo (JP)

(72) Inventors: Jun Arikata, Himeji (JP); Shigenobu Nishida, Himeji (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/689,897

(22) Filed: Aug. 29, 2017

(65) Prior Publication Data

US 2017/0355543 A1 Dec. 14, 2017

Related U.S. Application Data

(63) Continuation of application No. 14/826,751, filed on Aug. 14, 2015, which is a continuation of application (Continued)

(30) Foreign Application Priority Data

Jun. 27, 2011 (JP) ..... 2011-142385
Jun. 27, 2011 (JP) ..... 2011-142386
Jun. 27, 2011 (JP) ..... 2011-142387
Jun. 27, 2011 (JP) ..... 2011-142388

(51) Int. Cl.
*B65H 5/22* (2006.01)
*B65H 5/06* (2006.01)

(Continued)

(52) U.S. Cl.
CPC ..... *B65H 5/068* (2013.01); *B65H 3/0684* (2013.01); *B65H 5/021* (2013.01); *B65H 29/006* (2013.01); *B65H 29/52* (2013.01); *G07D 11/0006* (2013.01); *B65H 2301/4191* (2013.01); *B65H 2404/1421* (2013.01); *B65H 2404/264* (2013.01); *B65H 2404/2611* (2013.01);

(Continued)

(58) Field of Classification Search
CPC .. B65H 16/005; B65H 23/025; B65H 29/006; B65H 2404/611; B65H 2404/6111
See application file for complete search history.

(56) References Cited

U.S. PATENT DOCUMENTS 5,126,002 A * 6/1992 Iwata ..... B65B 27/08 156/468
6,568,673 B2 * 5/2003 Mochizuki ..... B65H 5/28 271/213

(Continued)

*Primary Examiner* — Howard J Sanders
(74) *Attorney, Agent, or Firm* — Renner, Kenner, Greive, Bobak, Taylor & Weber

(57) ABSTRACT

An object of the invention is to provide a banknote storing/feeding unit which is capable of effectively utilizing winding spaces of a drum and a reel, to increase the number of banknotes to be stored. The banknote storing/feeding unit includes the drum which winds and rewinds a banknote together with a tape, and the reel which winds and rewinds the tape on and from the drum. A guide body swinging according to winding and rewinding of the tape and the banknote on and from the drum is provided between the drum and the reel. The guide body has a guide passage that guides the tape and the banknote to be wound and rewound on the drum. The guide body swings centering on a supporting point located within a region parallel to a virtual line connecting a rotational center of the drum and a rotational center of the reel.

11 Claims, 10 Drawing Sheets

Related U.S. Application Data

No. 13/533,141, filed on Jun. 26, 2012, now Pat. No. 9,150,375.

(51) Int. Cl.

| | |
|---|---|
| ***B65H 29/00*** | (2006.01) |
| ***B65H 29/52*** | (2006.01) |
| ***G07D 11/00*** | (2006.01) |
| ***B65H 3/06*** | (2006.01) |
| ***B65H 5/02*** | (2006.01) |

(52) U.S. Cl.

CPC ..... *B65H 2404/2613* (2013.01); *B65H 2404/6111* (2013.01); *B65H 2404/6112* (2013.01); *B65H 2701/1912* (2013.01)

(56) References Cited

U.S. PATENT DOCUMENTS

| | | | | |
|---|---|---|---|---|
| 8,844,805 | B2 * | 9/2014 | Yokote ..... | G07D 11/0006 235/379 |
| 9,595,154 | B2 * | 3/2017 | Takada ..... | G07D 11/0081 |
| 2001/0022258 | A1 * | 9/2001 | Satou ..... | B65H 29/006 194/206 |
| 2011/0079675 | A1 * | 4/2011 | Iwatsuki ..... | B65H 29/006 242/397 |

* cited by examiner

BANKNOTE STORING/FEEDING UNIT

CROSS-REFERENCE TO RELATED APPLICATION

This application is a continuation of U.S. patent application Ser. No. 14/826,751 filed on Aug. 14, 2015; which was a continuation of U.S. patent application Ser. No. 13/533,141 filed on Jun. 26, 2012 (now U.S. Pat. No. 9,150,375); and which claimed priority from Japanese Patent Application Nos. 2011-142385 filed on Jun. 27, 2011, 2011-142386 filed on Jun. 27, 2011, 2011-142387 filed on Jun. 27, 2011 and 2011-142388 filed on Jun. 27, 2011. The entire contents of all are incorporated herein by reference.

FIELD OF THE INVENTION

The present invention relates to a banknote storing/feeding unit which performs storing and feeding of banknotes along with winding and rewinding of tapes.

BACKGROUND OF THE INVENTION

Conventionally, among banknote handling machines such as a banknote depositing and dispensing machine that process depositing and dispensing of banknotes, there is a banknote handling machine equipped with a tape storage type (tape single-wound type) banknote storing/feeding unit using one tape in order to perform storing and feeding of banknotes.

For example, as disclosed in European Patent No. 0795842 or International Publication No. WO 2008/047094, this banknote storing/feeding unit includes a drum that winds and rewinds one end of one tape, a reel that winds and rewinds the other end of the tape on and from the drum, an inlet/outlet for receiving banknotes transported from the outside and for feeding banknotes to the outside, and a guide body which is disposed so as to be swingable between the drum and the reel, to guide the tape and banknotes wound on and rewound from the drum, and the like. The guide body has a supporting point in the vicinity of the inlet/outlet, and forms a swinging passage swingable centering on this supporting point.

Then, banknotes transported from the outside are received from the inlet/outlet into the swinging passage of the guide body, to send the banknotes from the swinging passage of the guide body to a space between the tape to be wound on the drum and the outer circumferential surface of the drum, thereby the banknotes are wound on the drum together with the tape, to be stored. On the other hand, the tape is rewound from the drum, to feed the banknotes from between the tape to be rewound and the outer circumferential surface of the drum to the swinging passage of the guide body, and the banknotes are fed from the swinging passage to the outside via the inlet/outlet.

The guide body is configured to swing according to a wound amount of which the tape and the banknotes are wound on the drum (an outer wound diameter of the drum), to share a space for winding the tape and the banknotes on the drum and a space for winding the tape on the reel as a space in which the guide body swings.

However, because the supporting point around which the guide body swings is out of a region parallel to a virtual line connecting a rotational center of the drum and a rotational center of the reel, it is impossible to take a large turning angle of the guide body between the drum and the reel. Further, because the supporting point around which the guide body swings is near the inlet/outlet, it is impossible to take a large turning angle of the guide body.

As described above, in a tape single-wound type banknote storing/feeding unit, it is impossible to take a large turning angle of the guide body between the drum and the reel. Therefore, there has been a problem that it is impossible to effectively utilize the winding spaces of the drum and the reel, and the storing number of banknotes which are wound on the drum to be stored is small.

The present invention has been achieved in consideration of the above-described circumstances, and an object of the present invention is to provide a banknote storing/feeding unit which is capable of effectively utilizing winding spaces of the drum and the reel, to increase the number of banknotes to be stored.

SUMMARY OF THE INVENTION

A banknote storing/feeding unit of the present invention, which stores a banknote transported from the outside, and feeds the stored banknote to the outside, includes a tape, a drum which one end of the tape is attached to, and winds and rewinds the banknote together with the tape, a reel which another end of the tape is attached to, and winds and rewinds the tape on and from the drum, and a guide body which has a guide passage that guides the tape to be wound and rewound on and from the drum, and guides the banknote to be wound and rewound together with the tape on and from the drum, wherein the guide body swings according to winding and rewinding of the tape and the banknote on and from the drum between the drum and the reel centering on a supporting point located within a region parallel to a virtual line connecting a rotational center of the drum and a rotational center of the reel. Accordingly, it is possible to take a large turning angle of the guide body between the drum and the reel, and it is possible to effectively utilize the winding spaces of the drum and the reel, to increase the number of banknotes to be stored.

Further, in the banknote storing/feeding unit, the supporting point of the guide body is out of a maximum outer diameter portion in a maximum wound state in which a wound amount of the tape and the banknote on the drum is maximized, and a distance from the maximum outer diameter portion to the supporting point of the guide body is shorter than a distance from a rotational center of the reel to the supporting point of the guide body. Accordingly, it is possible to take a large turning angle of the guide body, and it is possible to effectively utilize the winding spaces of the drum and the reel, to increase the number of banknotes to be stored.

Further, in the banknote storing/feeding unit, the guide body is a curved shape so as to fit along the maximum outer diameter portion in the maximum wound state in which the wound amount of the tape and the banknote on the drum is maximized. Accordingly, it is possible to take a large turning angle of the guide body, and it is possible to effectively utilize the winding spaces of the drum and the reel, to increase the number of banknotes to be stored.

Further, in the banknote storing/feeding unit, the guide body has a contact roller that contacts any one of the tape and the banknote wound on the drum, and a downstream side thereof in a winding direction from a contact point between the drum and the tape. Accordingly, even when a distance between the supporting point of the guide body and the contact point on the drum side is elongated, to increase the number of banknotes to be stored, thereby increasing a difference between the minimum and maximum wound amounts of the tape and the banknotes by the drum, it is possible to always appropriately keep the relationship between the outer wound diameter of the drum and the swinging angle of the guide body, which makes it possible to securely wind and rewind the banknotes on and from the drum.

Further, the banknote storing/feeding unit further includes an inlet/outlet which receives the banknote transported from the outside, and feeds the banknote to the outside, and a fixed passage through which the inlet/outlet and the guide body are connected, to transport the banknote, and the supporting point of the guide body is located on the fixed passage side. Accordingly, it is possible to take a large turning angle of the guide body between the drum and the reel, and it is possible to effectively utilize the winding spaces of the drum and the reel, to increase the number of banknotes to be stored.

Further, a banknote storing/feeding unit of the present invention, which stores a banknote transported from the outside, and feeds the stored banknote to the outside, includes a tape, a drum which one end of the tape is attached to, and winds and rewinds the banknote together with the tape, a reel which another end of the tape is attached to, and winds and rewinds the tape on and from the drum, an inlet/outlet which receives the banknote transported from the outside, and feeds the banknote to the outside, a fixed passage which is formed toward the drum from the inlet/outlet, to transport the banknote therethrough, and a swinging passage which is connected to the fixed passage, guides the tape to be wound and rewound on and from the drum, and guides the banknote to be wound and rewound together with the tape on and from the drum, the swinging passage swings according to winding and rewinding of the tape and the banknote on and from the drum between the drum and the reel centering on a supporting point located on the fixed passage side. Accordingly, it is possible to dispose the supporting point of the swinging passage at any position other than the inlet/outlet. Therefore, it is possible to take a large turning angle of the swinging passage between the drum and the reel, and it is possible to effectively utilize the winding spaces of the drum and the reel, to increase the number of banknotes to be stored.

Further, in the banknote storing/feeding unit, the supporting point of the swinging passage is out of a maximum outer diameter portion in a maximum wound state in which a wound amount of the tape and the banknote on the drum is maximized, and a distance from the maximum outer diameter portion to the supporting point of the guide body is shorter than a distance from a rotational center of the reel to the supporting point of the guide body. Accordingly, it is possible to take a large turning angle of the swinging passage, and it is possible to effectively utilize the winding spaces of the drum and the reel, to increase the number of banknotes to be stored.

Further, in the banknote storing/feeding unit, the swinging passage is a curved shape so as to fit along the maximum outer diameter portion in the maximum wound state in which the wound amount of the tape and the banknote on the drum is maximized. Accordingly, it is possible to take a large turning angle of the swinging passage, and it is possible to effectively utilize the winding spaces of the drum and the reel, to increase the number of banknotes to be stored.

Further, in the banknote storing/feeding unit, the swinging passage has a contact roller that contacts any one of the tape and the banknote wound on the drum, and a downstream side thereof in a winding direction from a contact point between the drum and the tape. Accordingly, it is possible to elongate a distance between the supporting point of the swinging passage and the contact point on the drum side, which makes it possible to take a large turning angle of the swinging passage, and it is possible to effectively utilize the winding spaces of the drum and the reel, to increase the number of banknotes to be stored.

BRIEF DESCRIPTION OF THE DRAWINGS

FIG. 1A is a cross-sectional view of a minimum tape-wound state on a drum, and FIG. 1B is a cross-sectional view of a maximum tape-wound state on the drum.

DETAILED DESCRIPTION OF THE PREFERRED EMBODIMENT

Hereinafter, a first embodiment will be described with reference to FIGS. 1A-1B to 11A-11E.

Figure 7:
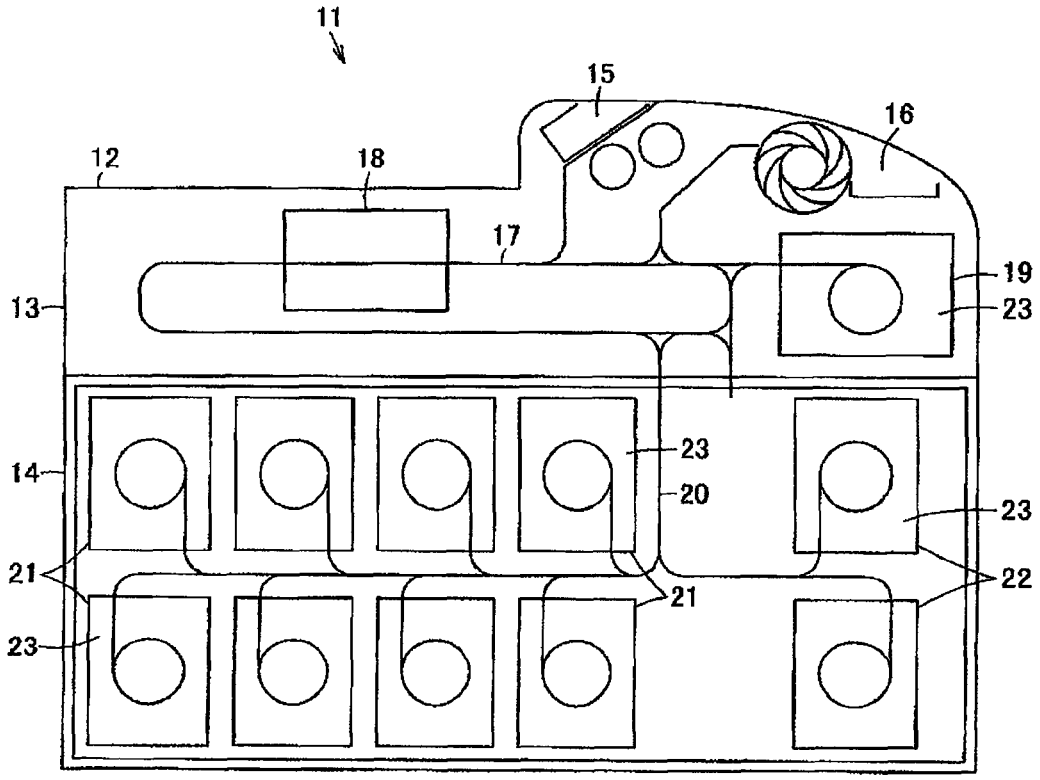
FIG. 7 is a cross-sectional view of a banknote handling machine using the banknote storing/feeding unit.

FIG. 7 shows a cross-sectional view of a banknote handling machine 11 serving as a banknote depositing and dispensing machine that deposits and dispenses banknotes. This banknote handling machine 11 includes a machine body 12, an upper unit 13 provided at the upper portion of the machine body 12, and a lower unit 14 which is provided at the lower portion of the machine body 12, and is able to be drawn out of the machine body 12.

In the upper unit 13, an inlet 15 into which banknotes are deposited, an outlet 16 from which the banknotes are dispensed, an upper transport path 17 through which the banknotes are transported, a recognition unit 18 that recognizes the banknotes transported through the upper transport path 17, and an escrow unit 19 that stores the banknotes sent into from the upper transport path 17 are disposed. For the outlet 16, a stacking wheel system stacking mechanism which receives the banknotes sent from the upper transport path 17 one by one, to stack those inside the outlet 16 is used.

In the lower unit 14, a lower transport path 20 connected to the upper transport path 17, denomination-specific banknote storing units 21 for storing the banknotes transported from the upper transport path 17 to the lower transport path 20, and banknote collecting units 22 for collection are disposed.

The escrow unit 19, the banknote storing units 21, and the banknote collecting units 22 are composed of banknote storing/feeding units 23 which store the banknotes one by one in a separated state, and feed the stored banknotes one by one. For this banknote storing/feeding unit 23, a tape storing type (tape single-wound type) using one tape is adopted.

In addition, at the respective positions at which the banknotes transported through the upper transport path 17 and the lower transport path 20 are diverted or jointed together, switching mechanisms (not shown) for smoothly diverting or joining the banknotes are disposed.

Further, in the present embodiment, a transporting direction of banknotes to be handled in the banknote handling machine 11 is a short edge direction perpendicular to a long edge direction of the banknotes. In addition, even when the transporting direction of the banknotes is directed to the long edge direction of the banknotes, it is possible to process those in the same way.

Then, in deposit processing of the banknote handling machine 11, for example, a plurality of banknotes collectively input to the inlet 15 are sent one by one into the upper transport path 17, to be recognized by the recognition unit 18. Banknotes recognized as normal banknotes are transported to the escrow unit 19, to be escrowed. Further, when an instruction is made to store the banknotes after the completion of processing up to escrowing of the banknotes input into the inlet 15, the banknotes escrowed in the escrow unit 19 are fed one by one to the upper transport path 17, to be recognized in the recognition unit 18, and are thereafter transported to the lower transport path 20, to be transported to the banknote storing unit 21 of a corresponding denomination, to be stored therein. In addition, provided that the storing order for the escrow unit 19 is memorized, recognition by the recognition unit 18 may be omitted. Further, when an instruction is made to return the banknotes, the banknotes escrowed in the escrow unit 19 are fed one by one to the upper transport path 17, to be transported to the outlet 16, to be returned.

In dispense processing of the banknote handling machine 11, the banknotes stored in the banknote storing unit 21 of a corresponding denomination to be dispensed are one by one fed to the lower transport path 20, and transported from the lower transport path 20 to the upper transport path 17, to be recognized by the recognition unit 18. Banknotes recognized as normal banknotes by the recognition unit 18 are transported to the outlet 16, to be dispensed.

Next, FIGS. 1 to 6 show the banknote storing/feeding unit 23 composing one of the banknote storing units 21. The banknote storing/feeding unit 23 includes a cuboid-shaped frame 32 including side panels 30 on the both sides, and a plurality of coupling members 31 coupling these side panels 30.

One surface of the frame 32 is formed as a passage surface 33 which faces the lower transport path 20 so as to compose a part of the lower transport path 20. An inlet/outlet 35 for inputting and outputting a banknote 34 with respect to the lower transport path 20 is formed to open into the passage surface 33.

Between the both side panels 30 of the frame 32, a drum 37 which one end of a tape 36 is attached, a reel 38 which the other end of the tape 36 is attached, a diverter lever 39 which takes the banknote 34 transported inside the lower transport path 20 into the inlet/outlet 35, or guides the banknote to be fed from the inlet/outlet 35 to the lower transport path 20, a transport mechanism 40 for transporting banknotes which is connected to the inlet/outlet 35, a swingable guide body 41 that guides the tape 36 and the banknote 34 between the transport mechanism 40 and the circumferential surface of the drum 37, and the like are disposed.

The drum 37 is disposed in a substantially central area between the side panels 30, the reel 38 is disposed alongside the inlet/outlet 35 and the side portion of the transport mechanism 40, and the guide body 41 is disposed so as to be swingable between the drum 37 and the reel 38.

A fixed passage 42 which is extended along a direction from the inlet/outlet 35 toward the drum 37, to connect the inlet/outlet 35 and the guide body 41 is formed by the transport mechanism 40. In the guide body 41, a guide passage 43 guiding the tape 36 and the banknote 34 is formed. This guide passage 43 is configured as a swinging passage 44 because the guide body 41 swings.

Then, in storing banknotes, the banknote 34 is taken-in from the inlet/outlet 35, and is transported to the drum 37 through the transport mechanism 40 and the guide body 41, and the banknote 34 is wound together with the tape 36 to be wound on the drum 37, to be stored. Further, in feeding banknotes, the banknote 34 is rewound from the drum 37 to the guide body 41, to be fed to the inlet/outlet 35 through the transport mechanism 40 by winding the tape 36 on the reel 38, that is, by rewinding the tape 36 from the drum 37.

Further, the tape 36 is formed such that the width thereof is smaller than a width intersecting with the transporting direction of the banknote 34, that is, the width in the long edge direction of the banknote 34 (hereinafter, simply called the width of the banknote 34). The two tapes 36 are used, and those are disposed in parallel with a space in the axial direction of the drum 37 and the reel 38. Therefore, the two tapes 36 are wound on the drum 37 so as to press two places in the width direction of the banknote 34, and in the wound state, the central portion and the both side portions in the width direction of the banknote 34 are exposed from between the two tapes 36 and the both sides of the two tapes 36.

The tape 36 is formed of, for example, a transparent film material having optical transparency at a predetermined level or more. For example, an opaque portion without optical transparency at a predetermined level or more, which is for sensing a limit to rewinding from the drum 37 is provided in the one end area of the tape 36 attached to the drum 37. For example, an opaque portion without optical transparency at a predetermined level or more, which is for sensing a limit to winding on the drum 37 is provided in the other end area of the tape 36 attached to the reel 38. These opaque portions are composed of, for example, opaque seals, and are pasted on the respective two tapes 36.

In addition, the surface of the tape 36 which is on the inner diameter side when the tape is wound on the drum 37 and the reel 38 is called a first surface 36*a* and the surface which is on the outer diameter side is called a second surface 36*b*.

Further, the drum 37 is a cylindrical shape with a larger diameter as compared with the reel 38, and is configured to be circumferentially rotatable at a fixed position centering on a drum axis 47 pivotally supported so as to be freely rotatable by the both side panels 30. A motor 48 for rotating the drum 37 is disposed on the inside of the drum 37, and the motor 48 is attached to one of the side panels 30.

The reel 38 is attached to a reel axis 49 pivotally supported so as to be rotatable by the both side panels 30 via a torque limiter 50, and is configured to be circumferentially rotatable at a fixed position centering on the reel axis 49.

On the outer side of the one of the side panels 30, a transmission mechanism that transmits rotary drive force from the drum 37 to the reel 38 is disposed, and a rotation amount sensing unit 51 that senses a rotation amount of the drum 37 is disposed. The transmission mechanism is equipped with a one-way clutch that transmits rotary drive force to the reel axis 49 in the winding direction of the reel 38, and which does not transmit rotary drive force to the reel axis 49 in the rewinding direction of the reel 38.

Then, in storing banknotes, when the drum 37 is rotary-driven in the winding direction by the motor 48, rotary drive force is not transmitted to the reel 38 by the one-way clutch, and the tape 36 wound on the drum 37 is against the torque limiter to be pulled out of the reel 38. Further, in feeding banknotes, when the drum 37 is rotary-driven in the rewinding direction by the motor 48, rotary drive force is transmitted to the reel 38 via the one-way clutch, and the reel 38 is rotated in the winding direction. At this time, the rotary drive force is transmitted to the reel 38 via the torque limiter 50 such that the speed of winding the tape 36 by the reel 38 is always faster than the speed of rewinding the tape 36 from the drum 37, which makes it possible to wind the tape 36 without slack by the reel 38.

Further, the diverter lever 39 is configured to be swingable as a supporting point of a lever axis 53, and to go forward and back with respect to the lower transport path 20 by driving of a solenoid. Then, due to the diverter lever 39 going forward to the lower transport path 20, the banknote 34 transported inside the lower transport path 20 is taken into the inlet/outlet 35, or the banknote 34 is fed from the inlet/outlet 35 to the lower transport path 20. On the other hand, due to the diverter lever 39 going back to the lower transport path 20, the banknote 34 transported inside the lower transport path 20 is allowed to pass through.

Further, the transport mechanism 40 is equipped with a pair of belts 55*a* and 55*b*, and a plurality of pulleys 56*a*, 56*b*, 57*a*, 57*b*, and 58 which install these belts 55*a* and 55*b* so as to stretch those along the both sides of the fixed passage 42 and the swinging passage 44, and bring the surfaces of the belts 55*a* and 55*b* into contact with each other. Among the plurality of pulleys 56*a*, 56*b*, 57*a*, 57*b*, and 58, the pulleys 56*a* and 56*b* disposed on the fixed passage 42 side are pivotally supported so as to be rotatable at fixed positions with respect to the both side panels 30 on the both sides of the inlet/outlet 35. Further, the pulleys 57*a* and 57*b* disposed on the swinging passage 44 side are pivotally supported so as to be rotatable by the guide body 41, to swing together with the guide body 41. Further, the pulley 58 disposed at the intermediate portion of the one belt 55*a* is pivotally supported so as to be rotatable at a fixed position with respect to the both side panels 30 at a position closer to the drum 37 than the inlet/outlet 35.

The pulley axis 59 of the pulley 58 serves as a supporting point 41*a* of the swinging guide body 41. The portion from the inlet/outlet 35 to the vicinity of the supporting point 41*a* is formed as the fixed passage 42, and the portion from the vicinity of the supporting point 41*a* to the inside of the guide body 41 is formed as the swinging passage 44. A fixed guide 60 that guides the banknote 34 is disposed on the fixed passage 42.

A gear 61 is attached to the axis of the pulley 56*b*, and when the banknote storing/feeding unit 23 is mounted into the banknote handling machine 11, the gear 61 engages with a gear of a driving mechanism disposed in the banknote handling machine 11, to transmit the rotary drive force from the driving mechanism to the belt 55*b* via the gear 61. The rotary drive force is transmitted from the gear 61 to the pulley axis 59 of the pulley 58 via a transmission unit 62, thereby transmitting the rotary drive force to the belt 55*a*.

Further, the guide body 41 has a first guide member 64 and a second guide member 65, and the both sides of the first guide member 64 and the second guide member 65 are integrally coupled by supporting members 66, and these supporting members 66 on the both sides are supported so as to be swingable by the pulley axis 59. That is, the guide body 41 is supported so as to be swingable centering on the supporting point 41*a*.

The inner surfaces of the first guide member 64 and the second guide member 65 facing each other are served as the passage surfaces, and the guide passage 43 that guides the tapes 36 and the banknote 34 is formed between these passage surfaces, that is, the swinging passage 44 swinging centering on the supporting point 41*a* is formed.

Figure 1A:
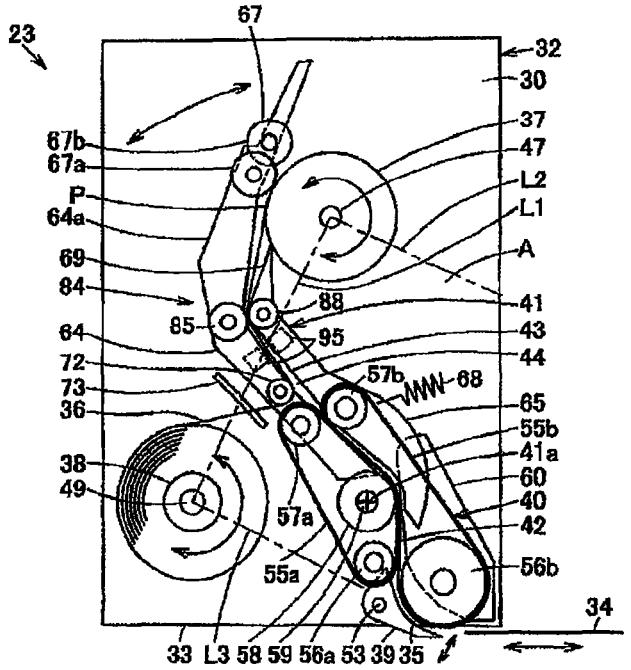
FIG. 1A and FIG. 1B show a banknote storing/feeding unit of a first embodiment.

The supporting point 41*a* of the guide body 41 is located at the end portion (the end portion closer to the drum 37) of the fixed passage 42 formed toward the drum 37 from the inlet/outlet 35. That is, as shown in FIG. 1A, the supporting point 41*a* of the guide body 41 is located within a region A parallel to a virtual line L1 connecting the rotational center of the drum 37 (the drum axis 47) and the rotational center of the reel 38 (the reel axis 49), and between a (second) virtual line L2 perpendicular to the (first) virtual line L1 from the rotational center of the drum 37 (the drum axis 47) and a (third) virtual line L3 perpendicular to the virtual line L1 from the rotational center of the reel 38 (the reel axis 49). Moreover, as shown in FIG. 1B, the supporting point 41*a* of the guide body 41 is located out of a maximum outer diameter portion 37*a* in a maximum wound state in which a wound amount of the tapes 36 and the banknotes 34 on the drum 37 is maximized, and located at a position at which a distance from the maximum outer diameter portion 37*a* to the supporting point 41*a* of the guide body 41 is shorter than a distance from the rotational center of the reel 38 (the reel axis 49) to the supporting point 41*a* of the guide body 41, and at a substantially intermediate position between the maximum outer diameter portion 37*a* and the inlet/outlet 35.

Figure 1B:
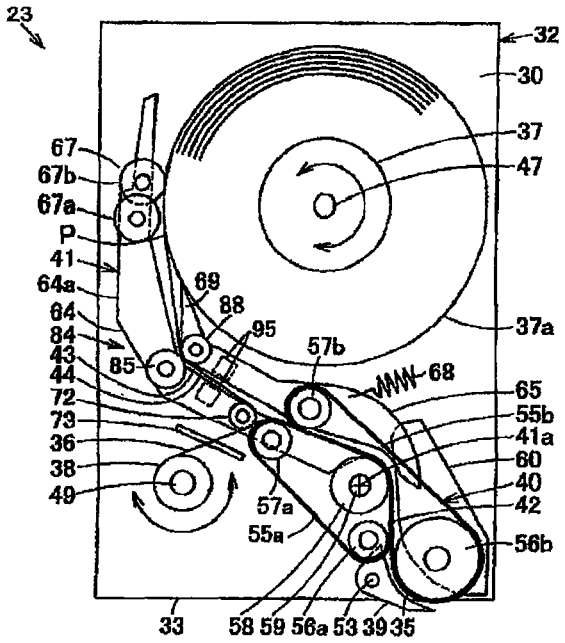
Figure 2:
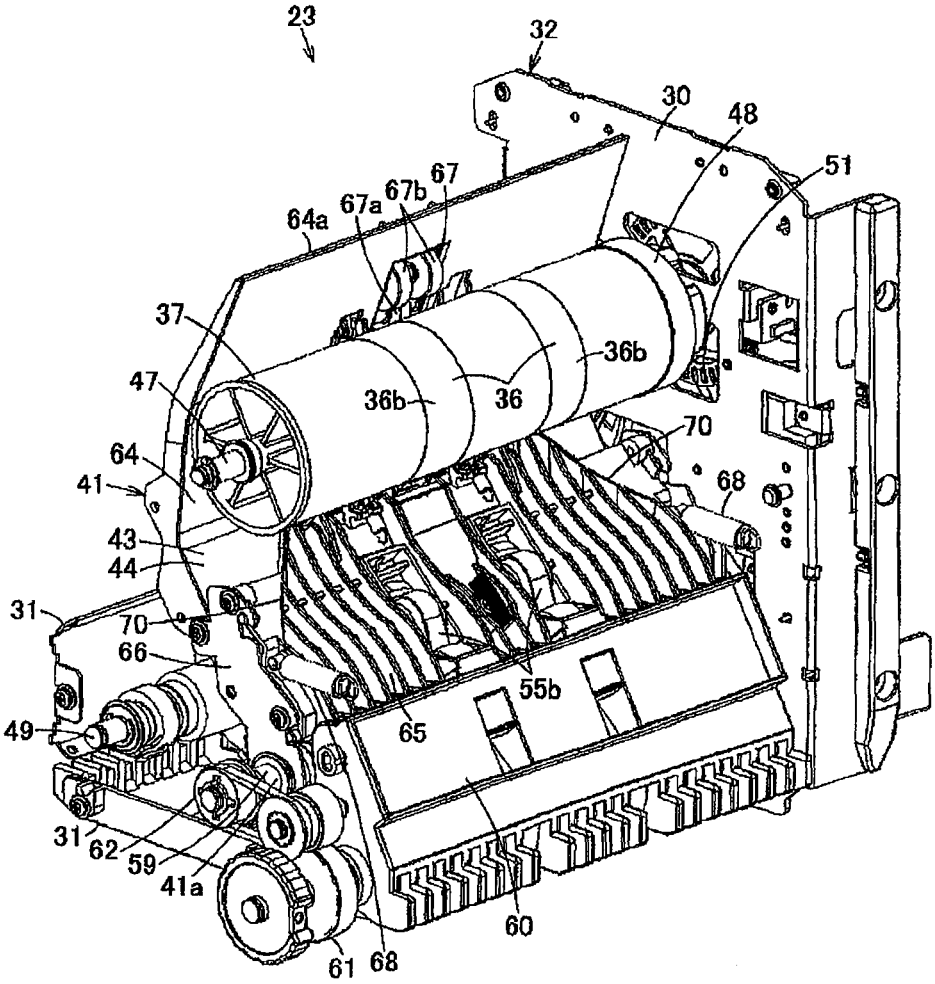
FIG. 2 is a perspective view of the banknote storing/feeding unit, which is partially omitted.

As shown in FIG. 1B, the shape of the guide body 41, that is, the shapes of the first guide member 64 and the second guide member 65 and the shapes of the guide passage 43 and the swinging passage 44 are curved shapes so as to fit along the maximum outer diameter portion 37*a* in the maximum wound state in which the wound amount of the tapes 36 and the banknotes 34 on the drum 37 is maximized.

An extension portion 64*a* extended so as to be longer than the tip end side opposite to the supporting point 41*a* of the second guide member 65 is formed on the tip end side opposite to the supporting point 41*a* of the first guide member 64. Contact rollers 67 directly contacting the drum 37 or the banknote 34 wound on the drum 37 via the space between the two tapes 36 on the downstream side in the winding direction from a contact point P of the tape 36 wound on the drum 37 are disposed at the extension portion 64*a* of the first guide member 64.

The contact rollers 67 are composed of a first contact roller 67*a* and a second contact roller 67*b*. The first contact roller 67*a* is brought into contact with the banknote 34 wound on the drum 37 when the outer diameter in a wound state in which a wound amount of the tapes 36 and the banknotes 34 on the drum 37 is less than a predetermined amount is smaller than a predetermined outer diameter. The second contact roller 67*b* is brought into contact with the banknote 34 wound on the drum 37 when the outer diameter in a wound state in which a wound amount of the tapes 36 and the banknotes 34 on the drum 37 is greater than a predetermined amount is larger than the predetermined outer diameter. In addition, both of the first contact roller 67*a* and the second contact roller 67*b* contact the downstream sides in the winding direction from the contact points P of the tapes 36 wound on the drum 37.

A spring 68 serving as a biasing unit that biases the guide body 41 to approach the drum 37 is installed to be stretched between the second guide member 65 of the guide body 41 and the frame 32. The contact rollers 67 are always pressed against the drum 37 by the bias from the spring 68.

Accordingly, the guide body 41 is configured to swing according to winding and rewinding of the tapes 36 and the banknote 34 on the drum 37 centering on the supporting point 41*a*.

Peeling claws 69 which peel the banknote 34 to be rewound together with the tape 36 from the drum 37 from the circumferential surface of the drum 37 to send the banknote 34 into the swinging passage 44 are disposed swingably on the tip end side of the second guide member 65 so as to correspond to the positions of the respective tapes 36. The peeling claws 69 are biased by springs or the like so as to swing toward the drum 37 such that the tip ends of the peeling claws 69 always contact the tapes 36.

The guide portions 70 whose both sides on the tip end side of the second guide member 65 are notched, and which guide the both side portions of the banknote 34 rewound from the drum 37 to easily go into the swinging passage 44 are formed on the both sides on the tip end side of the second guide member 65.

Further, with respect to the first guide member 64 and the second guide member 65, the pulleys 57*a* and 57*b* of the transport mechanism 40 are respectively pivotally supported so as to be rotatable.

Further, with respect to the first guide member 64, a guide roller 72 that guides the tape 36 between the reel 38 and the swinging passage 44 is pivotally supported so as to be rotatable, and a tape guide 73 that guides the tape 36 between the reel 38 and the guide roller 72 is attached.

Figure 3:
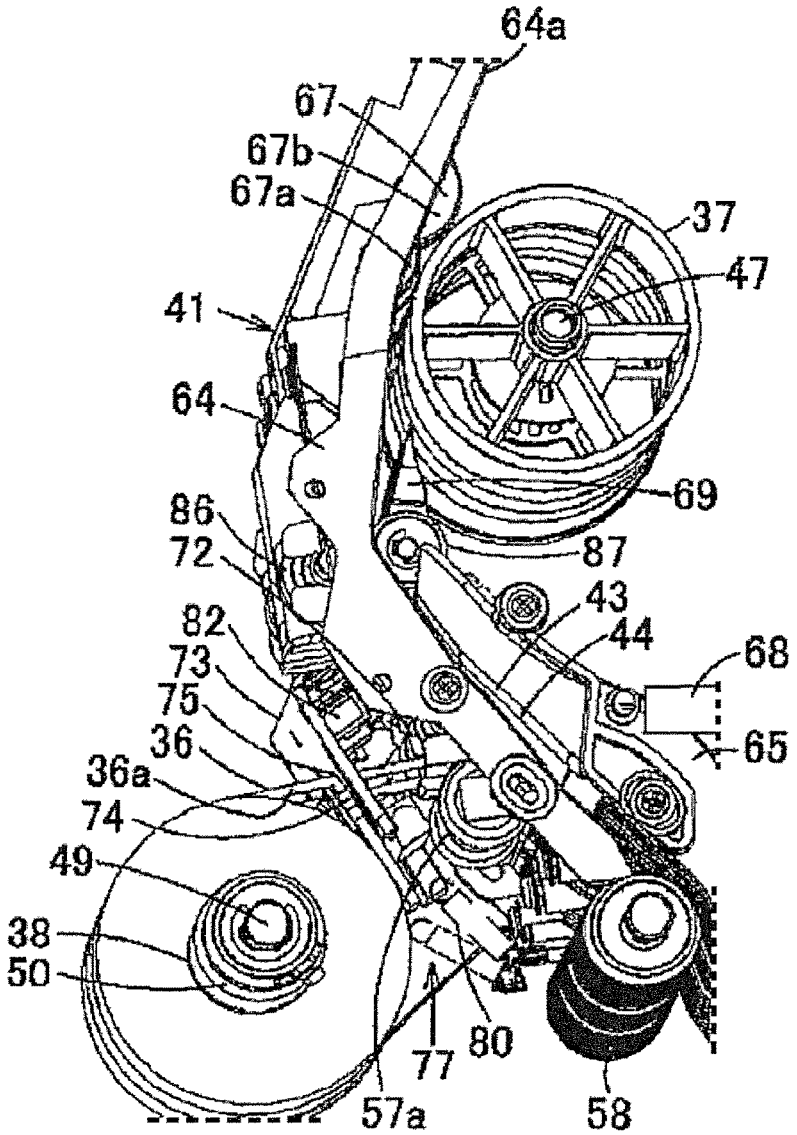
FIG. 3 is a perspective view of a part of the banknote storing/feeding unit.
Figure 4:
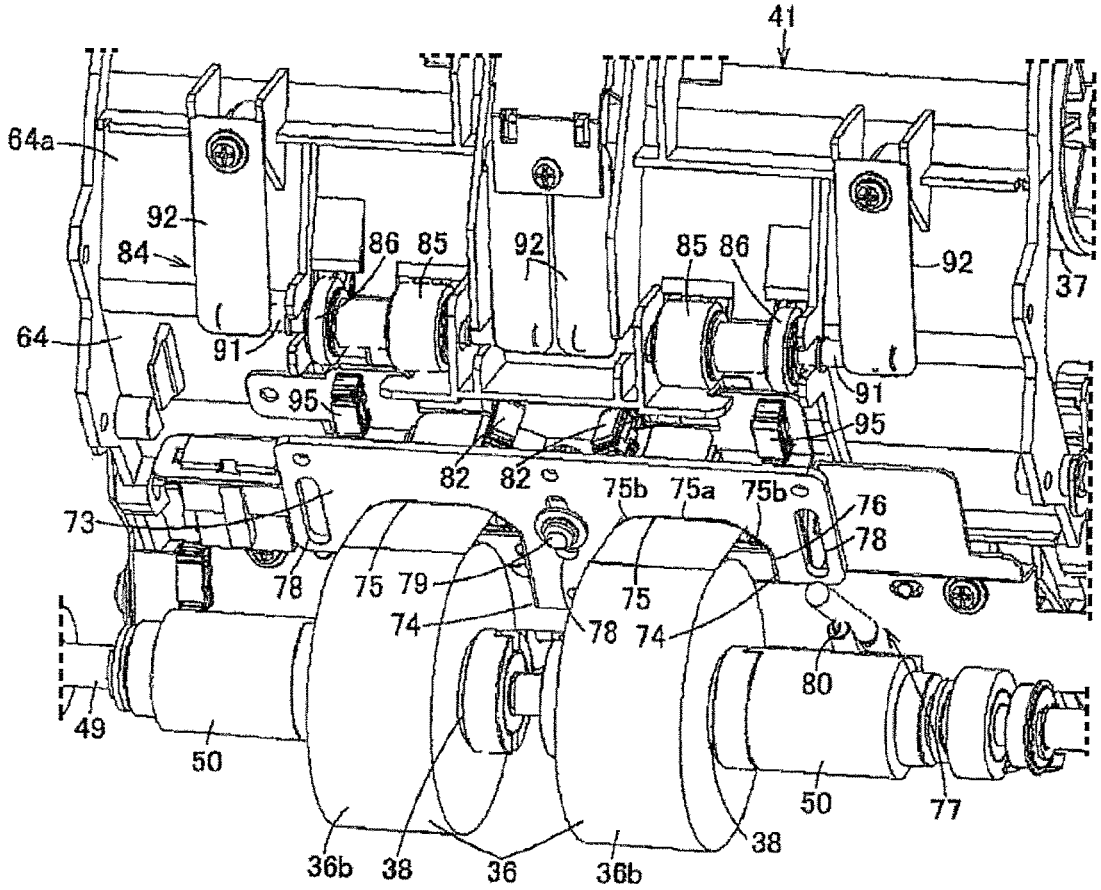
FIG. 4 is a perspective view in the vicinity of a reel of the banknote storing/feeding unit.

As shown in FIGS. 3 and 4, the tape guide 73 is formed of a tabular plate, and guide grooves 74 through which the respective tapes 36 are inserted to pass are formed in two places thereof, and guide surfaces 75 in which the tapes 36 slide are formed on the inner edges of these guide grooves 74. A straight surface 75*a* parallel to the axial direction of the reel 38 is formed on the center of the guide surface 75, and curved surfaces 75*b* are formed on the both sides of the straight surface 75*a*. In addition, regulation surfaces 76 perpendicular to the axial direction of the reel 38 are formed on the both sides of these curved surfaces 75*b*. The width of the straight surface 75*a* in the guide surface 75 is shorter than the width of the tape 36, and when the position in the width direction of the tape 36 is normal, the both sides in the width direction of the tape 36 are brought into contact with the curved surfaces 75*b*. Then, when the position in the width direction of the tape 36 is normal, the center in the width direction of the tape 36 is brought into contact with the straight surface 75*a* and the both sides in the width direction of the tape 36 are brought into contact with the curved surfaces 75*b*, and the tape 36 is curved in the width direction such that the first surface 36*a* of the tape 36 to be wound on the reel 38 becomes concave.

The tape guide 73 is supported by a tape guide moving unit 77 that moves the tape guide 73 according to a wound amount of the tapes 36 on the reel 38. This tape guide moving unit 77 supports the tape guide 73 slidably in a direction perpendicular to the surfaces of the tapes 36 by attaching a supporting member 79 on the first guide member 64 side via a slide groove 78 formed in the tape guide 73. A spring 80 serving as biasing unit is installed to be stretched between the tape guide 73 and the first guide member 64, and the spring 80 is configured to always press the guide surface 75 of the tape guide 73 with a predetermined pressing force.

In addition, tape end sensing units 82 which sense the opaque portions respectively provided at the one end areas and the other end areas of the tapes 36, to sense a limit to rewinding from the drum 37 and a limit to winding on the drum 37 are disposed at the first guide member 64. These tape end sensing units 82 are respectively disposed so as to correspond to each of the respective tapes 36.

Figure 5:
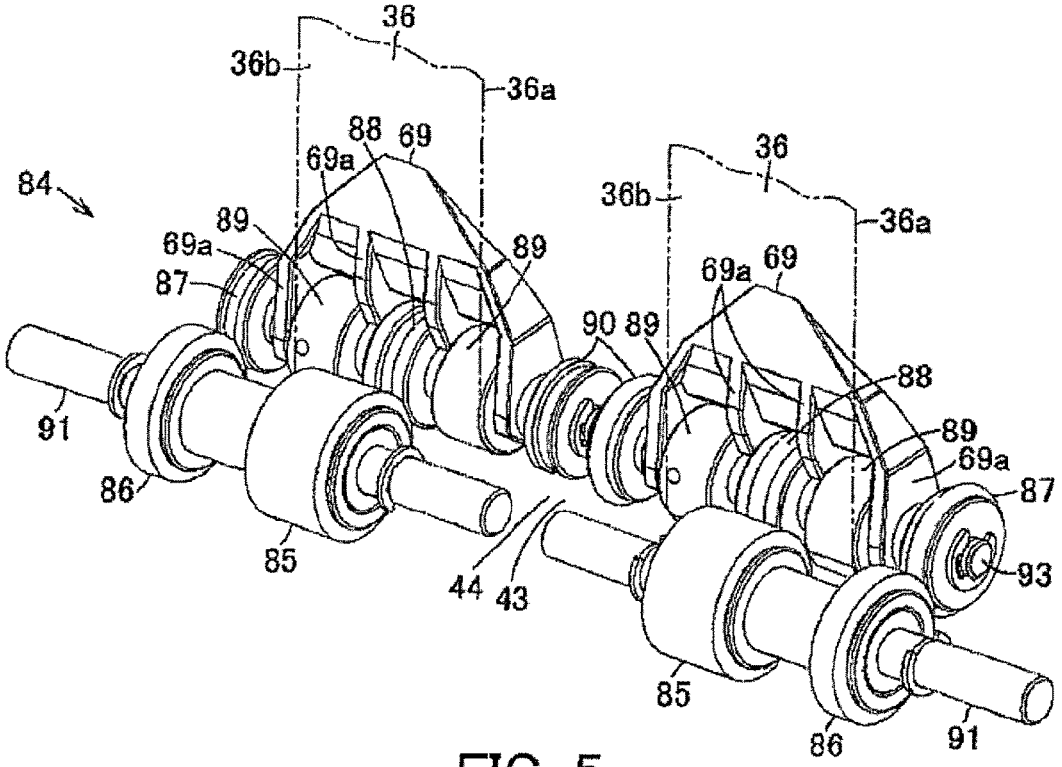
FIG. 5 is a perspective view in the vicinity of guidance rollers of the banknote storing/feeding unit.
Figure 6:
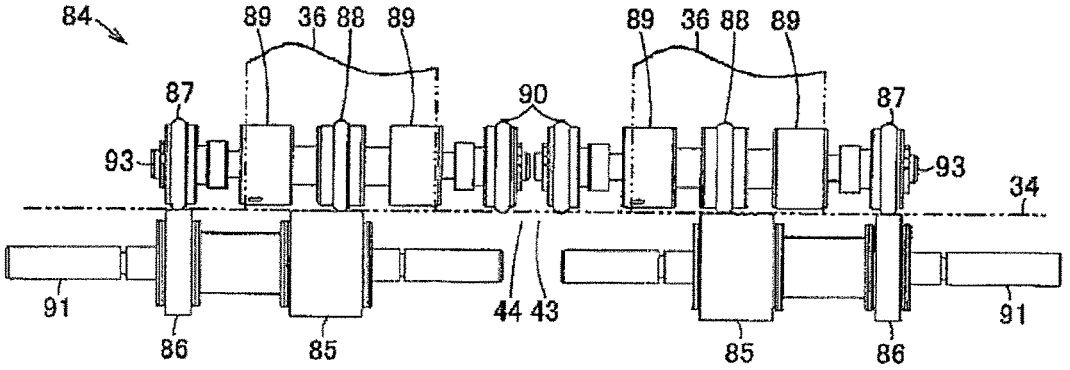
FIG. 6 is a plan view in the vicinity of the guidance rollers of the banknote storing/feeding unit.

Further, as shown in FIG. 1, guide mechanisms 84 that guide the tapes 36 and the banknote 34 between the guide roller 72 and the swinging passage 44 (the guide passage 43) are disposed in the vicinity of the tip end portion of the second guide member 65, and in the vicinity of the end portion of the swinging passage 44 (the guide passage 43) facing the drum 37. As shown in FIGS. 5 and 6, these guide mechanisms 84 are respectively disposed separately so as to correspond to the positions of the two tapes 36, and are equipped with driving rollers 85 and transmission rollers 86 which are disposed at the first guide member 64, and first to fourth guidance rollers 87, 88, 89, and 90 which are disposed at the second guide member 65.

The driving rollers 85 and the transmission rollers 86 are composed of rubber rollers whose circumferential surfaces are parallel to the axial direction, and those are provided so as to coaxially rotate integrally. These driving rollers 85 and transmission rollers 86 are pivotally supported so as to be rotatable by a roller axis 91 attached to the first guide member 64, and are projected from an opening portion formed in the first guide member 64 to the inside of the swinging passage 44. Plate springs 92 attached to the first guide member 64 are made to touch the both ends of the roller axis 91, and the driving rollers 85 and the transmission rollers 86 are biased so as to project to the inside of the swinging passage 44 by the plate springs 92. Then, the driving rollers 85 are disposed at positions at which the driving rollers 85 contact the second surfaces 36*b* of the tapes 36 to transmit the driving force, and the transmission rollers 86 are disposed at positions outward in the width direction of the tapes 36, and disposed at positions corresponding to the side part portions of the banknote 34 projecting from the tapes 36.

The first to fourth guidance rollers 87, 88, 89, and 90 are configured to coaxially rotate integrally by a roller axis 93 pivotally supported so as to be rotatable by the second guide member 65. The first, second, and fourth guidance rollers 87, 88, and 90 are composed of rubber rollers in which rubber O-rings are attached onto the circumferential surfaces thereof, and the third guidance rollers 89 are composed of rubber rollers whose circumferential surfaces are parallel to the axial direction. The first guidance rollers 87 are disposed at positions outward in the width direction of the tapes 36, and which correspond to the side part portions of the banknote 34 projecting from the tapes 36, and the first guidance rollers 87 are brought into point-contact with the transmission rollers 86. The second guidance rollers 88 are brought into point-contact with the first surfaces 36*a* of the tapes 36, to hold the tapes 36 between the driving rollers 85 and the second guidance rollers 88. The third guidance rollers 89 are disposed on the both sides in the axial direction of the second guidance rollers 88, and are made to face each other with a predetermined clearance from the first surfaces 36*a* of the tapes 36. The fourth guidance rollers 90 are disposed at positions which are opposite to the positions at which the first guidance rollers 87 are outward in the width direction of the tape 36, which correspond to the central portion of the banknote 34 between the two tapes 36. In addition, because the third guidance rollers 89 are not to hold the tapes 36, those may be not necessarily rubber rollers.

Then, at the time of winding and rewinding the tapes 36 on and from the drum 37, driving force is transmitted from the moving tapes 36 to the driving rollers 85 contacting the second surfaces 36*b* of the tapes 36, and the driving force is transmitted from the transmission rollers 86 rotating integrally with the driving rollers 85 to the first guidance rollers 87, and the driving force is transmitted from the first guidance rollers 87 to the second to fourth guidance rollers 88, 89, and 90.

In addition, distances from the contact points between the driving rollers 85 of the guide mechanism 84 and the second guidance rollers 88 and the contact points between the transmission rollers 86 and the first guidance rollers 87 to the contact portion between the pair of belts 55*a* and 55*b* are set to be measurements shorter than the length in the transporting direction of the banknote 34. With this, the banknote 34 in the swinging passage 44 is transported so as to be reliably held by at least one of the belts 55*a* and 55*b* and the guide mechanism 84. Further, distances from the contact points between the driving rollers 85 of the guide mechanism 84 and the second guidance rollers 88 and the contact points between the transmission rollers 86 and the first guidance rollers 87 to the contact point P at which the tapes 36 are wound on the drum 37 are set to be measurements shorter than the length in the transporting direction of the banknote 34. With this, the banknote 34 wound and rewound on and from the drum 37 is to be reliably held by at least one of the drum 37 and the guide mechanism 84.

Further, the peeling claws 69 are attached rotatably to the roller axis 93. A plurality of ribs 69*a* that get into the gaps between the first to fourth respective guidance rollers 87, 88, 89, and 90 to guide the banknote 34 are provided at the peeling claws 69.

Further, banknote sensing units 95 that sense the banknote 34 in a region in which the banknote 34 is transported together with the tapes 36 inside the swinging passage 44 are provided at the guide body 41. These banknote sensing units 95 are composed of optical sensors, and sense the banknote 34 due to a sensor light being blocked at the time of passage of the banknote 34.

Figure 8:
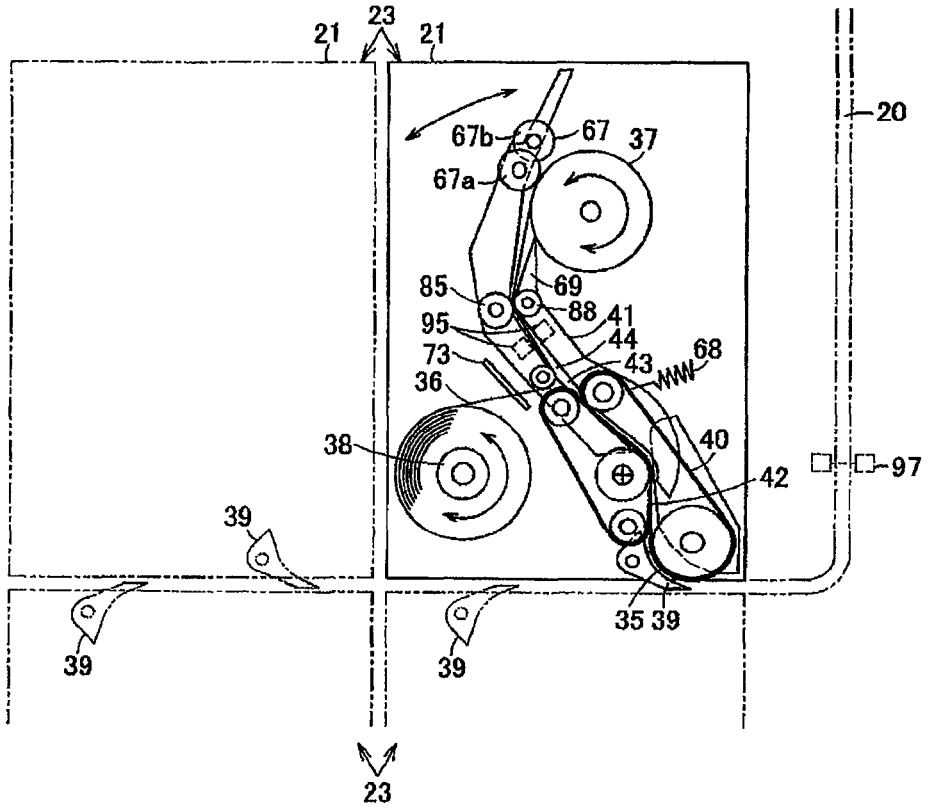
FIG. 8 is a cross-sectional view showing a part of a lower transport path in the banknote storing/feeding unit.

Further, FIG. 8 shows the lower transport path 20 and the banknote storing/feeding units 23 which are the plurality of banknote storing units 21 disposed along the lower transport path 20. A timing sensor 97 that senses the banknote 34 which is transported from the upper transport path 17, to be stored in each of the banknote storing units 21 is disposed on the lower transport path 20.

In addition, the banknote storing/feeding units 23 used as the escrow unit 19, the banknote storing units 21, and the banknote collecting units 22 have the same basic configuration, and are different in layout according to its arrangement and direction.

Next, the operation of the banknote storing/feeding unit 23 will be described.

First, the operation at the time of storing banknotes will be described.

In FIG. 8, the recognized banknote 34 to be stored in the banknote storing unit 21 is transported from the upper transport path 17 to the lower transport path 20.

When the banknote 34 transported to the lower transport path 20 is sensed by the timing sensor 97, in the banknote storing/feeding unit 23 serving as the banknote storing unit 21 of a corresponding denomination in which the banknote 34 is to be stored, the diverter lever 39 advances into the lower transport path 20 to take the banknote 34 transported into the inlet/outlet 35.

At this time, the transport mechanisms 40 of all the banknote storing/feeding units 23 are driven in the direction for storing the banknote 34 by the driving mechanism of the banknote handling machine 11. However, the motor 48 of the drum 37 in each of the banknote storing/feeding units 23 is not driven unless the banknote 34 is taken in up to a predetermined position in the banknote storing/feeding unit 23.

The banknote 34 taken into the inlet/outlet 35 is pinched between the belts 55*a* and 55*b* of the transport mechanisms 40, to be transported from the fixed passage 42 to the swinging passage 44 in the guide body 41.

After a predetermined time after the banknote 34 transported to the lower transport path 20 is sensed by the timing sensor 97, the motor 48 of the banknote storing/feeding unit 23 of the corresponding denomination in which the banknote 34 is to be stored is driven in a direction corresponding to the banknote storing direction, to rotate the drum 37 in the winding direction, and the drum 37 starts winding the tapes 36.

The rotation of the motor 48 is transmitted to the transmission mechanism of the reel axis 49, but not transmitted to the reel axis 49 by the one-way clutch of the transmission mechanism. Therefore, the reel 38 attached to the reel axis 49 via the torque limiter 50 does not rotate in the rewinding direction, to apply a tension to the tapes 36 wound on the drum 37. Further, when the tension applied to the tapes 36 exceeds a set torque value of the torque limiter 50, a slippage is caused in the torque limiter 50, and the reel 38 rotates in the rewinding direction. Accordingly, the tapes 36 are rewound from the reel 38 so as to be under a given tension.

Figure 9A:
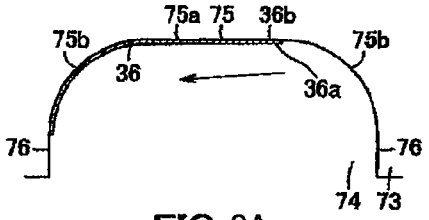
FIGS. 9A, 9B and 9C are explanatory diagrams for explaining the operation of a tape guide of the banknote storing/feeding unit.
Figure 9B:
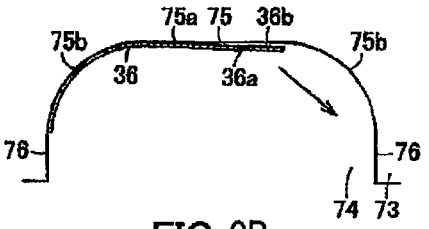
Figure 9C:
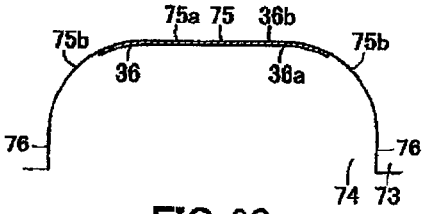

The tapes 36 rewound from the reel 38 so as to be under tension move into the swinging passage 44 through the tape guide 73. At this time, as shown in FIG. 9C, in the case where the position in the width direction of the tape 36 is normal with respect to the guide surface 75 of the tape guide 73, the center in the width direction of the tape 36 is brought into contact with the straight surface 75*a* and the both sides in the width direction of the tape 36 are brought into contact with the curved surfaces 75*b*, and the tape 36 is curved in the width direction. In this state, contact resistances with the curved surfaces 75*b* on the both sides are applied to the both sides in the width direction of the tape 36, to exert an action to bring the tape 36 to the center by the tensional force of the tape 36, thereby holding the position in the width direction of the tape 36 in a normal state. If the tape 36 is shifted to the left side as shown in FIG. 9A, the frictional resistance between the left side of the tape 36 and the curved surface 75*b* on the left side is increased, thereby moving the tape 36 to the right side with less frictional resistance as shown in FIG. 9B, and the position in the width direction of the tape 36 is corrected to be in a normal state as shown in FIG. 9C. Accordingly, it is possible to wind the tape 36 on the drum 37 in a state in which the position in the width direction of the tape 36 is normal.

Then, when the tip end in the transporting direction of the banknote 34 reaches the guide mechanism 84, the tapes 36 and the banknote 34 are pinched between the driving rollers 85 and the second guidance rollers 88, to send the tapes 36 and the banknote 34 together toward the outer circumferential surface of the drum 37. Further, the both side portions of the banknote 34 out of the tapes 36 are pinched between the transmission rollers 86 and the first guidance rollers 87, to be sent toward the outer circumferential surface of the drum 37. Moreover, the central portion of the banknote 34 out of the tapes 36 is transported toward the outer circumferential surface of the drum 37 by the fourth guidance rollers 90. Moreover, the tapes 36 and the banknote 34 sent by the second guidance rollers 88 are guided by the third guidance rollers 89 disposed on the both sides in the axial direction of the second guidance rollers 88.

The banknote 34 is pinched between the tapes 36 and the outer circumferential surface of the drum 37 at the contact points P at which the tapes 36 contact the outer circumferential surface of the drum 37, to wind the banknote 34 on the drum 37 together with the tapes 36 to store it.

Then, when the passage of the banknote 34 to be wound on the drum 37 to be stored is sensed by the banknote sensing unit 95, the motor 48 is stopped to stop the rotation of the drum 37, that completes the storage of the one banknote 34.

Next, when the banknote sensing unit 95 senses the banknote 34 to be stored next, the motor 48 is again driven to rotate in the direction according to the banknote storing direction, to repeat the storing operation as described above.

With such a control, it is possible to wind the banknote 34 on the drum 37 to store it with an appropriate interval between banknotes.

Figure 10:
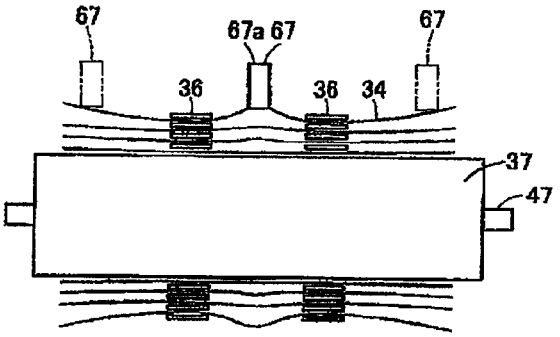
FIG. 10 is an explanatory diagram for explaining the operation of a contact roller of the banknote storing/feeding unit.

Further, the contact rollers 67 directly contact the banknote 34 between the two tapes 36 on the downstream side in the winding direction from the contact points P of the drum 37, to press the banknote 34 against the drum 37. As shown in FIG. 10 (a state in which the plurality of banknotes 34 are wound on the drum 37 is shown in FIG. 10), when the banknotes 34 are wound on the drum 37, the portions of the banknotes 34 which the tapes 36 contact are tightened up. However, the portions of the banknotes 34 other than the portions contacted with the tapes 36 easily swell, and the outer wound diameter of the drum 37 is increased on the swollen portions of the banknotes 34. When the contact rollers 67 contact the swollen portions of the banknotes 34, it is possible to appropriately keep the relationship between the outer wound diameter of the drum 37 and the swinging angle of the guide body 41, and it is also possible to suppress the swelling of the banknotes 34 to some extent.

Further, FIG. 1A shows a minimum wound state of the tapes 36 on the drum 37 (a state in which no banknote 34 is stored), and FIG. 1B shows a maximum wound state of the tapes 36 on the drum 37 (a state in which the banknotes 34 are stored to the maximum amount).

As shown in FIG. 1A, in the minimum wound state of the tapes 36 on the drum 37, the guide body 41 is detached from the reel 38 on which the tapes 36 are wound, and enters the winding space of the drum 37, to be closer to the drum 37 than the reel 38. Among the contact rollers 67, the first contact roller 67*a* contacts the drum 37, to appropriately keep the relationship between the outer wound diameter of the drum 37 and the swinging angle of the guide body 41.

As the tapes 36 and the plurality of banknotes 34 are wound on the drum 37, the outer diameter in the wound state of the tapes 36 on the drum 37 is increased. Due to the increase in the outer diameter in the wound state of the tapes 36 on the drum 37, the contact rollers 67 are pushed in the outer diameter direction of the drum 37, and the guide body 41 swings from the drum 37 side toward the reel 38 side so as to be against the biasing of the spring 68 centering on the supporting point 41*a*.

As shown in FIG. 1B, when the unit comes to the maximum wound state of the tapes 36 on the drum 37, the guide body 41 enters the winding space of the reel 38, to be closer to the reel 38 than the drum 37. Among the contact rollers 67, the second contact roller 67*b* contacts the drum 37, to appropriately keep the relationship between the outer wound diameter of the drum 37 and the swinging angle of the guide body 41.

In addition, because the rotation amount of the motor 48 from the start of winding of the tapes 36 on the drum 37 is sensed by the rotation amount sensing unit 51, the outer diameter of the drum 37 is judged on the basis of the rotation amount of the motor 48, to control the motor 48 such that the rotational speed of the outer diameter portion of the drum 37 is kept constant, that is the storing speed of the banknote 34 is kept constant. On the basis of the rotation amount of the motor 48, a full state in which the tape wound amount or the banknote stored amount is maximized is judged, to control the unit to stop the storage of the banknote 34.

Next, the operation in feeding of banknotes will be described.

In feeding of banknotes, the transport mechanisms 40 of all the banknote storing/feeding units 23 are driven in the direction for feeding the banknote 34 by the driving mechanism of the banknote handling machine 11.

Among the plurality of banknote storing/feeding units 23, the motors 48 of the drums 37 in the banknote storing/feeding units 23 in which the banknotes 34 of types to be fed are driven in order, to feed the banknotes 34 to the lower transport path 20 for each denomination one by one.

When the motor 48 of the banknote storing/feeding unit 23 is rotary-driven in the direction corresponding to the banknote feeding direction, the drum 37 rotates in the rewinding direction, to start rewinding the tapes 36 from the drum 37.

At the same time, the rotation of the motor 48 is transmitted to the reel axis 49 via the transmission mechanism and the one-way clutch, and the reel 38 rotates together with the reel axis 49 in the winding direction via the torque limiter 50, to start winding the tapes 36 by the reel 38.

At this time, regardless of a ratio of the tape wound amounts on the reel 38 and the drum 37, the tape winding speed by the reel 38 is faster than the tape rewinding speed from the drum 37, to apply a tension to the tapes 36 wound by the reel 38.

When the tension applied to the tapes 36 exceeds a set torque value of the torque limiter 50, a slippage is caused in the torque limiter 50, and the reel 38 rotates in the tape winding direction at a rotational speed slower than that of the reel axis 49 in a state in which a given torque is applied. Accordingly, the tapes 36 are wound on the reel 38 so as to be under a given tension.

Then, the banknote 34 is rewound together with the tapes 36 by rewinding the tapes 36 from the drum 37. The banknote 34 to be rewound from the drum 37 is securely peeled off from the circumferential surface of the drum 37 with the peeling claws 69, to transport the banknote 34 into the guide mechanism 84 through the space between the tapes 36 and the peeling claws 69.

In the guide mechanism 84, the tapes 36 and the banknote 34 are pinched between the driving rollers 85 and the second guidance rollers 88, and the tapes 36 and the banknote 34 are together sent into the swinging passage 44. Further, the both side portions of the banknote 34 out of the tapes 36 are pinched between the transmission rollers 86 and the first guidance rollers 87, to be sent into the swinging passage 44. Moreover, the central portion of the banknote 34 out of the tapes 36 is sent into the swinging passage 44 by the fourth guidance rollers 90. Moreover, the tapes 36 and the banknote 34 sent by the second guidance rollers 88 are guided by the third guidance rollers 89 disposed on the both sides in the axial direction of the second guidance rollers 88.

Figure 11A:
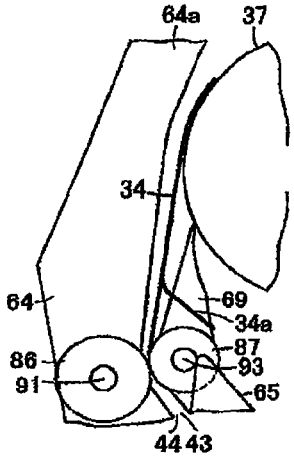
FIGS. 11A, 11B, 11C, 11D, and 11E are explanatory diagrams for explaining the operation of a first guidance roller of the banknote storing/feeding unit.

At the time of rewinding the banknote 34 from the drum 37, as shown in FIG. 11A, if there is a torn portion 34*a* torn at the tip end in the rewinding direction of the banknote 34 at the side part portions of the banknote 34 out of the tapes 36, the torn portion 34*a* of the banknote 34 does not get into the swinging passage 44 of the guide body 41, to get stuck on the outer side of the guide body 41, which may enlarge the torn portion of the banknote 34. Further, even if the banknote 34 is fed without being significantly torn, there is the problem that the banknote 34 gets stuck on the transport path, to easily cause a jam. In addition, the torn portion 34*a* of the banknote 34 does not project from the surface of the banknote 34 to the extension portion 64*a* side because there is the extension portion 64*a* of the first guide member 64. However, because there is the space on the second guide member 65 side, and the banknote 34 is curly because the banknote 34 has been wound around the drum 37, the torn portion 34*a* of the banknote 34 easily projects from the surface of the banknote 34 on the second guide member 65 side.

Figure 11B:
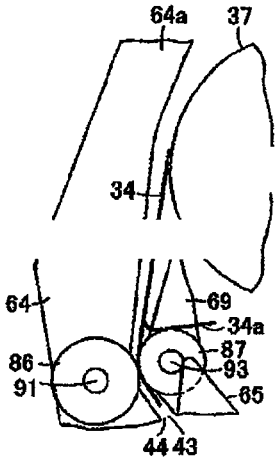
Figure 11C:
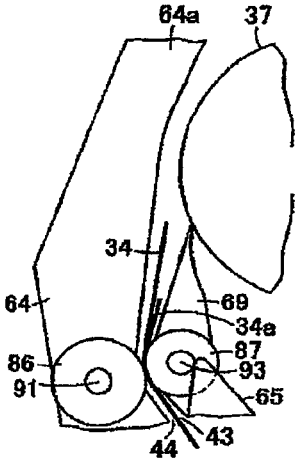
Figure 11D:
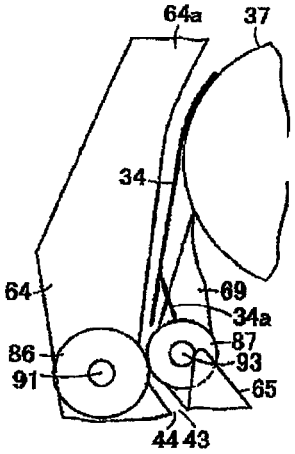
Figure 11E:
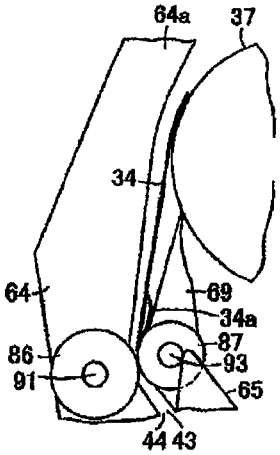

Because the first guidance rollers 87 rotary-driven in the rewinding direction are disposed at the positions which are out in the width direction of the tapes 36 at the end portions of the second guide member 65, as shown in FIGS. 11B and 11C, in the case where the surface of the torn portion 34*a* of the banknote 34 is brought into contact with the first guidance rollers 87, the torn portion 34*a* of the banknote 34 is forcibly folded in the opposite direction to the rewinding direction by the first guidance rollers 87, and the torn portion 34*a* of the banknote 34 is pinched between the first guidance rollers 87 and the transmission rollers 86 to be folded, to be sent into the swinging passage 44. Or, as shown in FIGS. 11D and 11E, in the case where the tip end of the torn portion 34*a* of the banknote 34 is brought into contact with the first guidance rollers 87, the tip end of the torn portion 34*a* of the banknote 34 is forcibly sent in the rewinding direction by the first guidance rollers 87, and the torn portion 34*a* of the banknote 34 is pinched between the first guidance rollers 87 and the transmission rollers 86, to be sent into the swinging passage 44.

Moreover, because the fourth guidance rollers 90 rotary-driven in the rewinding direction are disposed at the positions which are out in the width direction of the tape 36 at the end portions of the second guide member 65, even if there is a torn portion in the central portion of the banknote 34, it is possible to send the torn portion of the banknote 34 into the swinging passage 44 in the same way as the first guidance rollers 87.

Accordingly, even if the tip end in the rewinding direction of the banknote 34 to be rewound from the drum 37 is torn, it is possible to guide the torn portion of the banknote 34 into the swinging passage 44, which makes it possible to prevent the torn portion of the banknote 34 from enlarging, or the banknote 34 from jamming in the transport path.

Further, among the tapes 36 and the banknote 34 which are rewound from the drum 37 to be transported in the swinging passage 44, the tapes 36 are pulled out of the swinging passage 44 via the guide roller 72, to be wound on the reel 38, and the banknote 34 is pinched to be held between the pair of belts 55*a* and 55*b*, and is transported to the inlet/outlet 35 to be fed to the lower transport path 20.

Further, the tapes 36 pulled out of the swinging passage 44 via the guide roller 72 are wound on the reel 38 through the tape guide 73. At this time, as shown in FIG. 9C, in the case where the position in the width direction of the tape 36 is normal with respect to the guide surface 75 of the tape guide 73, the center in the width direction of the tape 36 is brought into contact with the straight surface 75*a* and the both sides in the width direction of the tape 36 are brought into contact with the curved surfaces 75*b*, and the tape 36 is curved in the width direction. In this state, contact resistances with the curved surfaces 75*b* on the both sides are applied to the both sides in the width direction of the tape 36, to exert an action to bring the tape 36 to the center by the tensional force of the tape 36, thereby holding the position in the width direction of the tape 36 in a normal state. If the tape 36 is shifted to the left side as shown in FIG. 9A, the frictional resistance between the left side of the tape 36 and the curved surface 75*b* on the left side is increased, thereby moving the tape 36 to the right side with less frictional resistance as shown in FIG. 9B, and the position in the width direction of the tape 36 is corrected to be in a normal state as shown in FIG. 9C. Accordingly, it is possible to wind the tape 36 on the reel 38 in a state in which the position in the width direction of the tape 36 is normal.

Moreover, because the guide surface 75 of the tape guide 73 curves the first surface 36*a* of the tape 36 wound on the reel 38 to be concave, even if the tape 36 reaches the reel 38 as is shifted in the width direction, the shifted side of the tape 36 is first brought into contact within the width of the reel 38, to transfer the contacting point with the reel 38 from the shifted side of the tape 36 to the opposite side. Therefore, it is possible to normally wind the tape 36 within the width of the reel 38.

Then, in the case where the number of the banknotes 34 to be fed is one, after the passage of the banknote 34 to be fed is sensed by the banknote sensing unit 95, when the tip end in the feeding direction of the banknote 34 to be fed next is sensed by the banknote sensing unit 95, the motor 48 is stopped to stop the rotation of the drum 37. With this, it is possible to stop the tip end in the feeding direction of the banknote 34 to be fed next at a predetermined feed standby position in the swinging passage 44, and it is possible to rapidly feed the banknote 34 at the time of next feeding of the banknote 34.

Further, in the case where the plurality of banknotes 34 are fed, the motor 48 is continuously driven until the passage of the number of banknotes 34 to be fed is sensed by the banknote sensing unit 95, and after the passage of the banknote 34 to be finally fed is sensed by the banknote sensing unit 95, when the tip end in the feeding direction of the banknote 34 to be fed next is sensed by the banknote sensing unit 95, the motor 48 is stopped, that completes the feeding of the plurality of banknotes 34.

Further, as the tapes 36 are rewound from the drum 37 to feed the banknotes 34, the outer diameter in the wound state of the tapes 36 on the drum 37 is decreased. Due to the decrease in the outer diameter in the wound state of the tapes 36 on the drum 37, the guide body 41 swings from the reel 38 side toward the drum 37 side centering on the supporting point 41*a* by the bias from the spring 68.

As shown in FIG. 1A, when the unit comes to the minimum wound state of the tapes 36 on the drum 37, the guide body 41 enters the winding space of the drum 37, to be closer to the drum 37 than the reel 38. Among the contact rollers 67, the first contact roller 67*a* directly contacts the banknote 34 wound on the drum 37 through the space between the two tapes 36, to appropriately keep the relationship between the outer wound diameter of the drum 37 and the swinging angle of the guide body 41 according to an outer diameter of the drum 37 in the correctly wound state.

In addition, because the rotation amount of the motor 48 from the start of rewinding of the tapes 36 from the drum 37 is sensed by the rotation amount sensing unit 51, the outer diameter of the drum 37 is judged on the basis of the rotation amount of the motor 48, to control the motor 48 such that the rotational speed of the outer diameter portion of the drum 37 is kept constant, that is the feeding speed of the banknote 34 is kept constant.

As described above, in the banknote storing/feeding unit 23 of the present embodiment, the supporting point 41*a* of the guide body 41 is disposed within the region A parallel to the virtual line L1 connecting the rotational center of the drum 37 and the rotational center of the reel 38, and within the region A between the virtual line L2 perpendicular to the virtual line L1 from the rotational center of the drum 37 and the virtual line L3 perpendicular to the virtual line L1 from the rotational center of the reel 38. Therefore, it is possible to take a large turning angle of the guide body 41 between the drum 37 and the reel 38, and it is possible to effectively utilize the winding spaces of the drum 37 and the reel 38 to increase the number of banknotes 34 to be stored.

For example, in the case where the supporting point 41*a* of the guide body 41 is disposed on the inlet/outlet 35 side out of the region A, the guide body 41 interferes with the reel 38, which make it impossible to take a large turning angle of the guide body 41. On the other hand, provided that the supporting point 41*a* of the guide body 41 is disposed within the region A, it is possible to take a large turning angle of the guide body 41 between the drum 37 and the reel 38.

Because the fixed passage 42 is provided toward the drum 37 from the inlet/outlet 35, and the swinging passage 44 swinging centering on the supporting point 41*a* located on the fixed passage 42 side, it is possible to dispose the supporting point 41*a* of the swinging passage 44 at any position other than the inlet/outlet 35. Therefore, it is possible to take a large turning angle of the swinging passage 44 between the drum 37 and the reel 38, and it is possible to effectively utilize the winding spaces of the drum 37 and the reel 38 to increase the number of banknotes 34 to be stored.

Because the supporting point 41*a* of the guide body 41 and the swinging passage 44 is located out of the maximum outer diameter portion 37*a* in the maximum wound state in which the wound amount of the tapes 36 and the banknotes 34 on the drum 37 is maximized, and located at the position at which the distance from the maximum outer diameter portion 37*a* to the supporting point 41*a* of the guide body 41 is shorter than the distance from the rotational center of the reel 38 to the supporting point 41*a* of the guide body 41, and at the substantially intermediate position between the maximum outer diameter portion 37*a* and the inlet/outlet 35, it is possible to have large turning angles of the guide body 41 and the swinging passage 44, and it is possible to effectively utilize the winding spaces of the drum 37 and the reel 38 to increase the number of banknotes 34 to be stored.

Because the guide body 41 and the swinging passage 44 are curved shapes so as to fit along the maximum outer diameter portion 37*a* in the maximum wound state in which the wound amount of the tapes 36 and the banknotes 34 on the drum 37 is maximized, it is possible to have large turning angles of the guide body 41 and the swinging passage 44, and it is possible to effectively utilize the winding spaces of the drum 37 and the reel 38 to increase the number of banknotes 34 to be stored.

Because the contact rollers 67 of the guide body 41 contact any one of the tape 36 and the banknote 34 wound on the drum 37, and the downstream side in the winding direction from the contact point P between the drum 37 and the tape 36, even when a distance between the supporting point 41*a* of the guide body 41 and the swinging passage 44 and the contact point P on the drum 37 side is elongated, to increase the number of banknotes 34 to be stored, thereby increasing a difference between the minimum and maximum wound amounts of the tapes 36 and the banknotes 34 by the drum 37, it is possible to always appropriately keep the relationship between the outer wound diameter of the drum 37 and the swinging angle of the guide body 41, which makes it possible to securely wind and rewind the banknote 34 on and from the drum 37. In particular, even when the outer wound diameter of the drum 37 is changed, it is possible to lessen a change in angle of the tip end of the peeling claw 69 provided on the guide body 41 with respect to the outer circumferential surface in the wound state of the drum 37, which makes it possible to securely rewind the banknote 34 from the drum 37.

Meanwhile, conventionally, when the banknotes are wound on the drum by the tape, the portions of the banknotes which the tapes contact are tightened up. However, the portions of the banknotes other than the portions which the tapes contact easily swell, and the outer wound diameter of the drum is increased on the swollen portions of the banknotes. Because the contact rollers of the guide body contact the tapes, the outer wound diameter of the drum is not accurately sensed, and the swollen portions of the banknotes contact the guide body, which may damage the banknotes or cause a jam, and it is impossible to appropriately keep the relationship between the outer wound diameter of the drum and the swinging angle of the guide body, which makes it easy to have an effect on winding and rewinding of the banknotes on and from the drum.

Then, the banknote storing unit 23 of the present invention which stores the banknotes 34 transported from the outside, and feeds the stored banknotes 34 to the outside, includes the tape 36, the drum 37 which one end of the tape 36 is attached to, and winds and rewinds the banknote 34 together with the tape 36, the reel 38 which the other end of the tape 36 is attached to, and winds and rewinds the tape 36 on and from the drum 37, and the guide body 41 which has the guide passage 43 that guides the tape 36 to be wound and rewound on and from the drum 37, and guides the banknote 34 to be wound and rewound together with the tape 36 on and from the drum 37, and has the contact rollers 67 contacting the banknote 34 wound on the drum 37, the guide body 41 swings according to winding and rewinding of the tape 36 and the banknote 34 on and from the drum 37 between the drum 37 and the reel 38. In this way, because the contact rollers 67 of the guide body 41 directly contact the banknote 34 wound on the drum 37 by the tape 36, it is possible to always appropriately keep the relationship between the outer wound diameter of the drum 37 and the swinging angle of the guide body 41 according to an accurate outer wound diameter of the drum 37, which makes it possible to securely wind and rewind the banknote 34 on and from the drum 37.

Moreover, the contact rollers 67 contact the downstream side in the winding direction from the contact point P of the tape 36 wound on the drum 37. Therefore, after the banknote 34 is wound on the drum 37 by the tape 36, the contact rollers 67 contact the banknote 34, which makes it possible to prevent the banknote 34 from being shifted by the contact with the contact rollers 67.

Moreover, the tapes 36 are two, which are wound with a space in the axial direction of the drum 37, and the contact rollers 67 contact banknote 34 between the two tapes 36. In this way, because the contact rollers 67 contact the banknote 34 between the two tapes 36 wound with a space in the axial direction of the drum 37, it is possible to press the banknote 34 that is going to be shifted due to a variation in tightening of the two tapes 36 with the contact rollers 67, and it is possible to press the swollen portion of the banknote 34 between the two tapes 36 by the contact rollers 67, to suppress the swelling of the banknote 34.

Moreover, the contact rollers 67 have the first contact roller 67*a* which is brought into contact with the banknote 34 wound on the drum 37 when the outer diameter in a wound state in which a wound amount of the tapes 36 and the banknotes 34 on the drum 37 is less than a predetermined amount is smaller than a predetermined outer diameter, and the second contact roller 37*b* which is brought into contact with the banknote 34 wound on the drum 37 when the outer diameter in a wound state in which a wound amount of the tapes 36 and the banknotes 34 on the drum 37 is greater than a predetermined amount is larger than the predetermined outer diameter. In this way, because the first contact roller 67*a* of the contact rollers 67 is brought into contact with the banknote 34 wound on the drum 37 when the outer diameter in a wound state in which a wound amount of the tapes 36 and the banknotes 34 on the drum 37 is less than a predetermined amount is smaller than a predetermined outer diameter, and the second contact roller 67*b* of the contact rollers 67 is brought into contact with the banknote 34 wound on the drum 37 when the outer diameter in a wound state in which a wound amount of the tapes 36 and the banknotes 34 on the drum 37 is greater than a predetermined amount is larger than the predetermined outer diameter, even when the wound amount of the drum 37 changes, it is possible to always appropriately keep the relationship between the outer wound diameter of the drum 37 and the swinging angle of the guide body 41, which makes it possible to securely wind and rewind the banknote 34 on and from the drum 37.

In particular, because the tip end of the peeling claw 69 is worn away by friction with the tapes 36, as the outer wound diameter of the drum 37 increases, an angle between the tip end of the peeling claw 69 and the outer surface in the wound state of the drum 37 is reduced. Therefore, a gap is generated between the tip end of the peeling claw 69 and the outer surface in the wound state of the drum 37, which makes it impossible to securely peel the banknote 34 from the drum 37 with the tip end of the peeling claw 69 in some cases. Therefore, when the outer wound diameter of the drum 37 is large, the second contact roller 67*b* is brought into contact with the banknote 34 wound on the drum 37, which causes the tip end of the peeling claw 69 to swing the guide body 41 so as not to reduce the angle with the outer surface in the wound state of the drum 37, to prevent generation of a gap between the tip end of the peeling claw 69 and the outer surface in the wound state of the drum 37, which makes it possible to securely peel the banknote 34 from the drum 37 with the tip end of the peeling claw 69.

Moreover, the tapes 36 are two, which are wound with a space in the axial direction of the drum 37, and the contact rollers 67 contact the banknote 34 at the positions outward of the two tapes 36. That is, as the contact rollers 67 are shown by the dashed-two dotted lines in FIG. 10, the contact rollers 67 may be configured to contact the banknote 34 at the outer sides from the two tapes 36 wound with a space in the axial direction of the drum 37. In this case as well, it is possible to press the outer side portions of the banknote 34 swelling out of the two tapes 36, to suppress the swelling of the banknotes 34. In this case, the contact rollers 67 may be configured to contact only one side of the both side portions of the banknote 34 outward of the tapes 36, or may be configured to contact the both sides. Even in the case where the contact rollers 67 are configured to contact only one side of the both side portions of the banknote 34 outward of the tapes 36, the contact rollers 67 contact the downstream side in the winding direction from the contact points P of the tapes 36 wound on the drum 37, thereby making the contact rollers 67 contact the banknote 34 after the banknote 34 is wound on the drum 37 by the tape 36. Therefore, it is possible to prevent the banknote 34 from being shifted by the contact of the contact rollers 67. Further, the contact rollers 67 may be configured to contact the banknote 34 at both of the space between the two tapes 36 and the both outer sides of the tapes 36.

Further, conventionally, at the time of rewinding a banknote from the drum, if there is a torn portion at the tip end in the rewinding direction of the banknote in the portion of the banknote out of the tapes, the torn portion at the banknote may not get into the guide passage of the guide body, to get stuck on the outer side of the guide body, which may enlarge the torn portion in the banknote. In addition, even if the banknote is fed without being significantly torn, there is the problem that the banknote gets stuck on the transport path, to easily cause a jam.

Then, the banknote storing unit 23 of the present invention which stores the banknotes 34 transported from the outside, and feeds the stored banknotes 34 to the outside, includes the tape 36 having the first surface 36*a* and the second surface 36*b*, the drum 37 which one end of the tape 36 is attached to, and winds and rewinds the banknote 34 which is along the first surface 36*a* of the tape 36, together with the tape 36, the reel 38 which the other end of the tape 36 is attached to, and winds and rewinds the tape 36 on and from the drum 37, and the guide body 41 which has the guide passage 43 that guides the tape 36 to be wound and rewound on and from the drum 37, and guides the banknote 34 which is along the first surface 36*a* of the tape 36, to be wound and rewound together with the tape 36 on and from the drum 37, and in the guide passage 43 facing the drum 37, the first guidance roller 87 which is rotary-driven in a direction corresponding to the moving direction of the tape 36 wound and rewound on and from the drum 37 is disposed at the position out in the width direction of the tape 36 on the first surface 36*a* side of the tape 36. In this way, because the first guidance roller 87 which is rotary-driven in the direction corresponding to the moving direction of the tape 36 wound and rewound on and from the drum 37 is disposed at the position out in the width direction of the tape 36 on the first surface 36*a* side of the tape 36 on the end portion side of the guide passage 43 facing the drum 37, even when the tip end in the rewinding direction of the banknote 34 to be rewound from the drum 37 is torn, it is possible to guide the torn portion of the banknote 34 into the guide passage 43, which makes it possible to prevent the torn portion of the banknote 34 from enlarging, or the banknote 34 from jamming in the transport path.

Moreover, at the guide body 41, the second guidance roller 88 which is coaxially rotated integrally with the first guidance roller 87, and contacts the first surface 36*a* of the tape 36 is disposed, and the driving roller 85 which contacts the second surface 36*b* of the tape 36 to hold the tape 36 between the second guidance roller 88, and to which driving force is transmitted is disposed, and the driving force is transmitted from the driving roller 85 to the first guidance roller 87. In this way, because the second guidance roller 88 which is coaxially rotated integrally with the first guidance roller 87, and contacts the first surface 36*a* of the tape 36 is provided, and the driving roller 85 which contacts the second surface 36*b* of the tape 36 to hold the tape 36 between the second guidance roller 88, and to which driving force is transmitted from the tape 36 is provided, and the driving force is transmitted from the driving roller 85 to the first guidance roller 87, it is possible to rotary-drive the first guidance roller 87 by the driving force from the tape 36.

Moreover, at the guide body 41, the transmission roller 86 which is coaxially rotated integrally with the driving roller 85 is disposed at a position out in the width direction of the tape 36, and the transmission roller 86 contacts the first guidance roller 87 to transmit the driving force from the driving roller 85 to the first guidance roller 87. In this way, because the transmission roller 86 which is coaxially rotated integrally with the driving roller 85 is provided at the position out in the width direction of the tape 36, and the transmission roller 86 contacts the first guidance roller 87, it is possible to transmit the driving force from the driving roller 85 to the first guidance roller 87 by the transmission roller 86, and it is possible to forcibly fold the torn portion of the tip end in the rewinding direction of the banknote 34 between the first guidance roller 87 and the transmission roller 86, to guide the banknote 34 into the guide passage 43, which makes it possible to prevent the torn portion of the banknote 34 from enlarging, or the banknote 34 from jamming in the transport path.

Moreover, the first guidance roller 87 is brought into point-contact with the transmission roller 86. Therefore, it is possible to prevent the banknote 34 to be wound and rewound on and from the drum 37 from meandering, and it is possible to easily smooth wrinkles in and swelling of the banknote 34.

Moreover, the second guidance roller 88 is brought into point-contact with the tape 36. Therefore, it is possible to prevent the tape 36 to be wound and rewound on and from the drum 37 from meandering. Further, it is possible to prevent the banknote 34 to be wound and rewound on and from the drum 37 from meandering, and it is possible to easily smooth wrinkles in and swelling of the banknote 34.

Moreover, at the guide body 41, the third guidance roller 89 which is coaxially rotated integrally with the first guidance roller 87, and guides the first surface 36*a* of the tape 36 is disposed. In this way, because the third guidance roller 89 which is coaxially rotated integrally with the first guidance roller 87, and guides the first surface 36*a* of the tape 36 is provided, it is possible to securely guide the tape 36.

Moreover, at the guide body 41, the fourth guidance roller 90 which is coaxially rotated integrally with the first guidance roller 87 is disposed at a position opposite to the position at which the first guidance roller 87 is out in the width direction of the tape 36. Therefore, by the first guidance roller 87 and the fourth guidance roller 90, even when the tip end in the rewinding direction of the banknote 34 is torn in the portion of the banknote out of the both sides of the tape 36, it is possible to guide the torn portion of the banknote 34 into the guide passage 43, which makes it possible to prevent the torn portion of the banknote 34 from enlarging, or the banknote from jamming in the transport path.

Moreover, the first guidance roller 87 and the transmission roller 86 are rubber rollers. Therefore, it is possible to securely transmit driving force, and it is easy to forcibly fold the torn portion of the tip end in the rewinding direction of the banknote 34 between the first guidance roller 87 and the transmission roller 86.

Moreover, the second guidance roller 88 is a rubber roller. Therefore, it is possible to securely guide the torn portion of the tip end in the rewinding direction of the banknote 34 into the guide passage 43.

Furthermore, the fourth guidance roller 90 is a rubber roller. Therefore, it is possible to securely guide the torn portion of the tip end in the rewinding direction of the banknote 34 into the guide passage 43.

Further, conventionally, it is regulated such that the tape is not shifted in the width direction with the vertical walls provided on the both sides of the moving region of the tape. However, in fact, the regulation starts working after a shift exceeding the width of the reel to some extent is caused, and it is impossible to securely regulate the shift. Further, when a shifted amount of the tape exceeds a predetermined amount, there is the problem that the tape is folded, to be wound on the reel or the drum in the folded state, which causes an abnormality in winding such as an increase in the wound diameter on the folded portion of the tape.

Then, the banknote storing unit 23 of the present invention which stores the banknotes 34 transported from the outside, and feeds the stored banknotes 34 to the outside, includes the tape 36, the drum 37 which one end of the tape 36 is attached to, and winds and rewinds the banknote 34 together with the tape 36, the reel 38 which the other end of the tape 36 is attached to, and winds and rewinds the tape 36 on and from the drum 37, and a tape guide 73 having a guide surface 75 that curves the tape 36 in the width direction between the drum 37 and the reel 38. In this way, because the tape 36 is curved in the width direction between the drum 37 and the reel 38 by the guide surface 75 of the tape guide 73, it is possible to prevent a shift in the width direction of the tape 36 moving between the drum 37 and the reel 38, and even if a shift is caused, it is possible to automatically correct the shift.

Moreover, the guide surface 75 of the tape guide 73 curves the surface (the first surface 36*a*) of the tape 36 to be wound on the reel 38 so as to be concave. Therefore, even if the tape 36 is shifted in the width direction, the shifted side of the tape 36 is first brought into contact within the width of the reel 38, which makes it possible to normally wind the tape 36 within the width of the reel 38.

Moreover, the guide surface 75 of the tape guide 73 has the straight surface 75*a* in the center thereof, and the curved surfaces 75*b* curved from the both sides of the straight surface 75*a*. Therefore, an action to bring the tape 36 to the center of the guide surface 75 is exerted, which makes it possible to keep the position in the width direction of the tape 36 constant, and even if the tape 36 is shifted in the width direction, it is possible to automatically correct the shift.

Moreover, the banknote storing unit 23 includes the tape guide moving unit 77 that moves the tape guide 73 according to a wound amount of the tape 36 on the reel 38. With this, the tape guide moving unit 77 moves the tape guide 73 according to a wound amount of the tape 36 on the reel 38, which makes it possible to appropriately keep the relationship between the wound amount of the tape 36 on the reel 38 and the position of the tape guide 73.

Moreover, tape guide moving unit 77 has the biasing unit (the spring 80) that biases the guide surface 75 of the tape guide 73 in a direction in which the guide surface 75 is pressed against the tape 36. With this, because the guide surface 75 of the tape guide 73 is biased in the direction in which the guide surface 75 is pressed against the tape 36 by the biasing unit (the spring 80) of the tape guide moving unit 77, it is possible to keep the position in the width direction of the tape 36 constant, and even if the tape 36 is shifted in the width direction, it is possible to automatically correct the shift.

Figure 12:
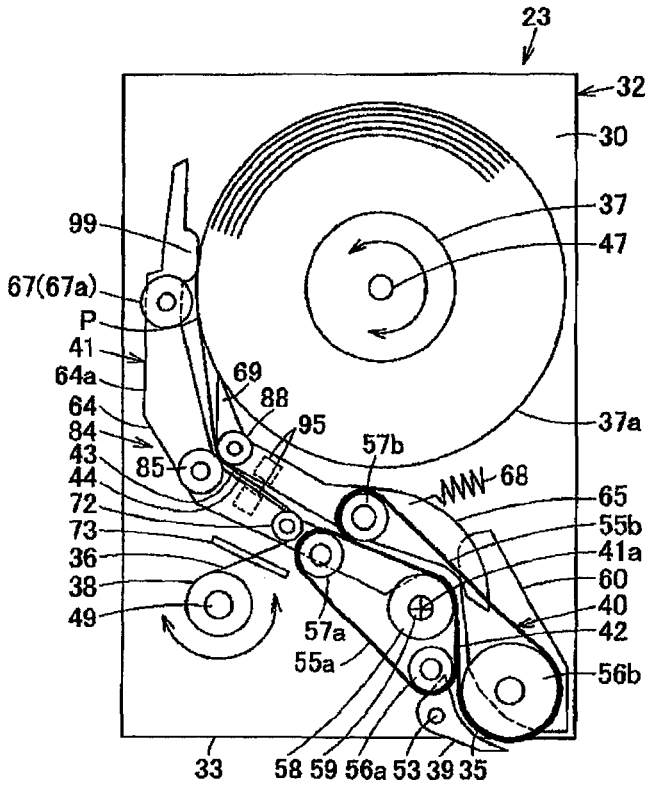
FIG. 12 shows a banknote storing/feeding unit of a second embodiment, that is a cross-sectional view of a maximum tape-wound state on a drum.

In addition, FIG. 12 shows a second embodiment of the present invention. The guide body 41 is brought into contact with the banknote 34 wound on the drum 37 when the outer diameter in a wound state in which a wound amount of the tapes 36 and the banknotes 34 on the drum 37 is less than a predetermined amount is smaller than a predetermined outer diameter, and the guide member 41 has a contact member 99 which is brought into contact with the banknote 34 wound on the drum 37 when the outer diameter in a wound state in which a wound amount of the tapes 36 and the banknotes 34 on the drum 37 is greater than a predetermined amount is larger than the predetermined outer diameter.

This contact member 99 may be formed integrally with the first guide member 64, or may be formed separately from the first guide member 64, to be attached to the first guide member 64.

Then, because the contact roller 67 is brought into contact with the banknote 34 wound on the drum 37 when the outer diameter in the wound state in which the wound amount of the tapes 36 and the banknotes 34 on the drum 37 is less than the predetermined amount is smaller than the predetermined outer diameter, and the contact member 99 of the guide member 41 is brought into contact with the banknote 34 wound on the drum 37 when the outer diameter in the wound state in which the wound amount of the tapes 36 and the banknotes 34 on the drum 37 is greater than the predetermined amount is larger than the predetermined outer diameter, even when the wound amount of the drum 37 is changed, it is possible to always appropriately keep the relationship between the outer wound diameter of the drum 37 and the swinging angle of the guide body 41, which makes it possible to securely wind and rewind the banknote 34 on and from the drum 37.

Further, in place of the first contact roller 67*a* and the second contact roller 67*b*, contact members corresponding to the first contact roller 67*a* and the second contact roller 67*b* may be provided at the first guide member 64.

In addition, in the aforementioned present embodiment, the number of the tapes 36 is not limited to two, and it is possible even for only one tape to wind and rewind the banknote 34 on and from the drum 37.

What is claimed is:

1. A banknote storing/feeding unit which stores a banknote transported from the outside, and feeds the stored banknote to the outside comprising:

a tape;

a drum which one end of the tape is attached to, and winds and rewinds the banknote together with the tape;

a reel which another end of the tape is attached to, and winds and rewinds the tape on and from the drum; and a tape guide having a guide surface that is brought into contact with the tape after having been rewound from the reel and before being wound on the drum, and curves the tape in the width direction, wherein the tape slides on the guide surface of the tape guide to curve the tape in the width direction.

2. The banknote storing/feeding unit according to claim 1, wherein the guide surface of the tape guide curves the surface of the tape to be wound on the reel so as to be concave.

3. The banknote storing/feeding unit according to claim 1, wherein the guide surface of the tape guide has a straight surface in the center thereof parallel to the axial direction of the reel, and curved surfaces curved from the both sides of the straight surface in the direction parallel to the axial direction of the reel.

4. The banknote storing/feeding unit according to claim 3, wherein regulation surfaces perpendicular to the axial direction of the reel are formed on the both sides of the curved surfaces.

5. The banknote storing/feeding unit according to claim 1, further comprising:

a tape guide moving unit that moves the tape guide according to a wound amount of the tape on the reel.

6. The banknote storing/feeding unit according to claim 5, wherein the tape guide moving unit has a biasing unit that biases the guide surface of the tape guide in a direction in which the guide surface is pressed against the tape.

7. The banknote storing/feeding unit according to claim 1, wherein the tape guide is formed of a plate that includes a guide groove having the guide surface.

8. The banknote storing/feeding unit according to claim 1, wherein the guide surface curves the tape such that the surface of the tape which is on the inner diameter side when the tape is wound on the reel becomes concave.

9. The banknote storing/feeding unit according to claim 1, further comprising:

a guide passage being formed to be extended from an inlet/outlet of the banknote storing/feeding unit toward the drum and guiding the tape and the banknote, wherein the tape guide is brought into contact with the tape after having been pulled out of the guide passage and before being wound on the reel.

10. A banknote storing/feeding unit which stores a banknote transported from the outside, and feeds the stored banknote to the outside, comprising:

a tape;

a drum which one end of the tape is attached to, and winds and rewinds the banknote together with the tape;

a reel which another end of the tape is attached to, and winds and rewinds the tape on and from the drum; and a tape guide having a guide surface that is brought into contact with the tape after having been rewound from the reel and before being wound on the drum, and curves the tape in the width direction.

11. The banknote storing/feeding unit according to claim 10, further comprising:

a guide passage being formed to be extended from an inlet/outlet of the banknote storing/feeding unit toward the drum and guiding the tape and the banknote, wherein the tape guide is brought into contact with the tape after having been pulled out of the guide passage and before being wound on the reel.

* * * * *